US011817067B2

(12) United States Patent
Park et al.

(10) Patent No.: US 11,817,067 B2
(45) Date of Patent: Nov. 14, 2023

(54) DISPLAY DRIVING CIRCUIT

(71) Applicant: SAMSUNG ELECTRONICS CO., LTD., Suwon-si (KR)

(72) Inventors: Unki Park, Suwon-si (KR); Minsik Kim, Seongnam-si (KR); Hyeonsu Park, Seoul (KR); Jonghyuk Lee, Suwon-si (KR); Hyunwook Lim, Seoul (KR); Woohyuk Jang, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 99 days.

(21) Appl. No.: 17/221,461

(22) Filed: Apr. 2, 2021

(65) Prior Publication Data

US 2021/0319770 A1 Oct. 14, 2021

(30) Foreign Application Priority Data

Apr. 14, 2020 (KR) ..... 10-2020-0045439
Jul. 16, 2020 (KR) ..... 10-2020-0088464

(51) Int. Cl.
*G09G 5/393* (2006.01)
*G09G 5/395* (2006.01)
*G04G 9/00* (2006.01)

(52) U.S. Cl.
CPC ..... *G09G 5/393* (2013.01); *G04G 9/0082* (2013.01); *G09G 5/395* (2013.01); *G09G 2330/023* (2013.01); *G09G 2360/06* (2013.01)

(58) Field of Classification Search
CPC .. G09G 5/393; G09G 5/395; G09G 2330/023; G09G 2360/06; G09G 3/20; G09G 5/222; G09G 2340/0435; G09G 2340/12; G09G 2370/20; G09G 5/363; G09G 2330/021; G09G 2360/02; G09G 2370/08; G09G 3/3225; G09G 3/32; G09G 3/3208; G09G 3/36; G04G 9/0082
See application file for complete search history.

(56) References Cited

U.S. PATENT DOCUMENTS 10,366,669 B2 7/2019 Bae et al.
10,467,951 B2 11/2019 Bae et al.
10,551,904 B2 2/2020 Lee et al.
(Continued)

FOREIGN PATENT DOCUMENTS

KR 10-2017-0143347 A 12/2017
KR 10-2018-0024620 A 3/2018
KR 10-2018-0024621 A 3/2018

*Primary Examiner* — Bryan Earles
(74) *Attorney, Agent, or Firm* — Sughrue Mion, PLLC

(57) ABSTRACT

A display driving circuit for driving a display panel, including a first memory configured to store main image data received from outside of the display driving circuit; a second memory configured to store first additional image data in a normal mode, and to store second additional image data in an Always On Display (AOD) mode having lower power consumption than the normal mode; a normal mode controller configured to operate in the normal mode according to the first additional image data stored in the second memory; and an AOD mode controller configured to operate in the AOD mode according to the main image data stored in the first memory and the second additional image data stored in the second memory.

19 Claims, 12 Drawing Sheets

(56) References Cited

U.S. PATENT DOCUMENTS

| | | | | |
|---|---|---|---|---|
| 10,573,218 | B2 | 2/2020 | Bae et al. | |
| 2015/0185815 | A1* | 7/2015 | DeBates | G06F 1/3209 713/320 |
| 2015/0348514 | A1* | 12/2015 | Priel | G09G 5/397 345/547 |
| 2016/0027146 | A1* | 1/2016 | Kim | G09G 3/3648 345/82 |
| 2018/0040301 | A1 | 2/2018 | Bae et al. | |
| 2018/0061309 | A1 | 3/2018 | Bae et al. | |
| 2018/0204303 | A1 | 7/2018 | Bae et al. | |
| 2019/0066633 | A1 | 2/2019 | Zhu | |
| 2020/0090301 | A1 | 3/2020 | Kim et al. | |
| 2020/0294473 | A1* | 9/2020 | Tung | G06T 13/80 |
| 2021/0065660 | A1* | 3/2021 | Zhong | G06F 1/3265 |
| 2021/0256917 | A1* | 8/2021 | Lai | G09G 5/12 |

* cited by examiner

DISPLAY DRIVING CIRCUIT

CROSS-REFERENCE TO RELATED APPLICATIONS

This application is based on and claims priority under 35 U.S.C. § 119 to Korean Patent Application No. 10-2020-0045439, filed on Apr. 14, 2020, and Korean Patent Application No. 10-2020-0088464, filed on Jul. 16, 2020, in the Korean Intellectual Property Office, the disclosures of which are incorporated by reference herein in their entirety.

BACKGROUND

1. Field

The disclosure relates to a semiconductor device, and more particularly, to a display driving circuit for driving a display panel to display an image on the display panel.

2. Description of Related Art

A display device may include a display panel that displays an image and a display driving circuit that drives the display panel. The display driving circuit may receive image data from a processor and apply an image signal corresponding to the received image data to a data line of the display panel, thereby driving the display panel. The display device may be implemented in various forms such as a Liquid Crystal Display (LCD), a Light Emitting Diode (LED) display, an Organic LED (OLED) display, and an Active Matrix OLED (AMOLED) display.

As information technology advances, the use of small electronic devices is increasing. The small electronic devices may include a smart phone, a tablet PC, a Portable Multimedia Player (PMP), a laptop personal computer, and a wearable device. Because most small electronic devices operate based on power from a battery, it is important to reduce power consumption. Therefore, it is also important to reduce power consumption of a display device included in a small electronic device.

SUMMARY

Provided is a display driving circuit that operates in a normal mode and an Always On Display (AOD) mode.

In accordance with an aspect of the disclosure, a display driving circuit for driving a display panel includes a first memory configured to store main image data received from outside of the display driving circuit; a second memory configured to store first additional image data in a normal mode, and to store second additional image data in an Always On Display (AOD) mode having lower power consumption than the normal mode; a normal mode controller configured to operate in the normal mode according to the first additional image data stored in the second memory; and an AOD mode controller configured to operate in the AOD mode according to the main image data stored in the first memory and the second additional image data stored in the second memory.

In accordance with an aspect of the disclosure, a display driving circuit for driving a display panel includes a first memory configured to store first main image data in a normal mode and second main image data in an Always On Display (AOD) mode having lower power consumption than the normal mode; a distributor configured to receive the first main image data and the second main image data from the first memory, and distribute the first main image data and the second main image data according to a mode selection signal; a decoder configured to receive the first main image data from the distributor and decode the received first main image data, and generate the decoded first main image data; a normal mode controller configured to operate in the normal mode according to the decoded first main image data; and an AOD mode controller configured to receive the second main image data from the distributor and to operate in the AOD mode according to the second main image data.

In accordance with an aspect of the disclosure, a display driving circuit for driving a display panel includes a first memory configured to store merged image data received from outside of the display driving circuit; an image modification circuit configured to extract additional image data from the merged image data and to generate main image data; an internal time information generation circuit configured to generate internal time information based on a clock signal and time information; and an Always On Display (AOD) mode controller configured to operate in an AOD mode having lower power consumption than a normal mode according to the main image data, the additional image data, and the internal time information.

BRIEF DESCRIPTION OF THE DRAWINGS

Embodiments of the inventive concept will be more clearly understood from the following detailed description taken in conjunction with the accompanying drawings in which.

DETAILED DESCRIPTION OF THE EMBODIMENTS

Hereinafter, various embodiments of the present disclosure will be described with reference to the accompanying drawings.

Figure 1:
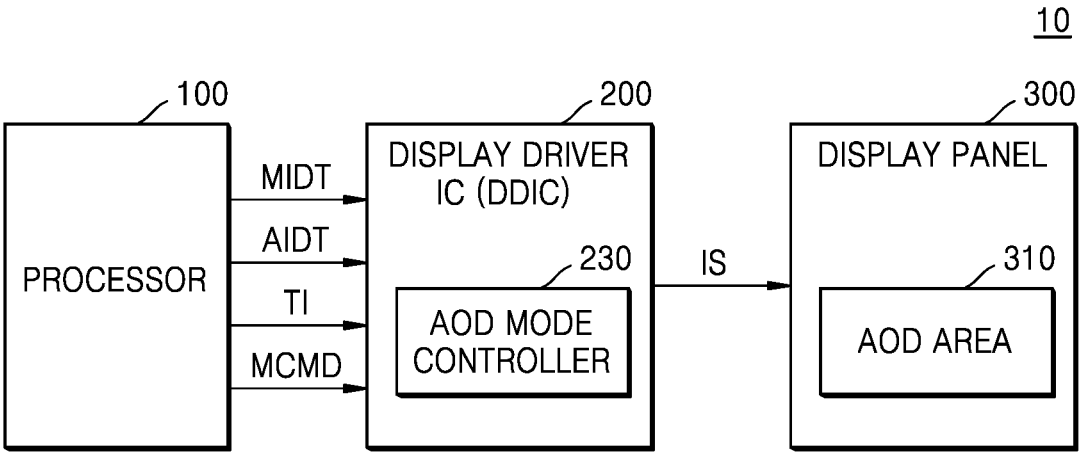
FIG. 1 is a block diagram illustrating a display system according to an embodiment.

FIG. 1 is a block diagram showing a display system according to an embodiment of the present disclosure.

A display system 10 according to an embodiment of the present disclosure may be mounted on an electronic device having an image display function. For example, electronic devices may include smartphones, tablet personal computers (PCs), portable multimedia players (PMPs), cameras, wearable devices, internet of things devices, televisions, digital video disk (DVD) players, refrigerators, air conditioners, air cleaners, set-top boxes, robots, drones, various medical devices, navigation devices, global positioning system receivers, advanced driver assistance systems (ADASs), vehicle devices, furniture, or various measuring devices.

Referring to FIG. 1, the display system 10 may include a processor 100, a display driver Integrated Circuit (IC) 200, and a display panel 300. In embodiments, display driver IC 200 may be a display driving circuit. In an exemplary embodiment, the display driver IC 200 and the display panel 300 may be implemented as one module, and the module may be referred to as a display device. For example, the display driver IC 200 may be mounted on a circuit film such as a Tape Carrier Package (TCP), a Chip On Film (COF), a Flexible Print Circuit (FPC), and the like to be attached to the display panel 300 in a Tape Automatic Bonding (TAB) method, or may be mounted on a non-display area of the display panel 300 in a Chip On Glass (COG) or Chip On Plastic (COP) method.

The display system 10 may operate in a normal mode and an Always On Display (AOD) mode, which may consume less power than the normal mode. The normal mode may mean a mode in which a screen is displayed through the display panel 300 while the processor 100 is in an active state, and may mean a state in which steady state power is provided to the processor 100. The normal mode may mean a mode in which the processor 100 controls the display driver IC 200 to display an image through the display panel 300. The AOD mode may mean a mode in which a screen is displayed through the display panel 300 while the processor 100 is in an inactive state. The inactive state may mean a turn-off state that requires booting to switch to the active state. The inactive state may mean a state in which power provided to the processor 100 is limited, and may mean a state in which power lower than the power provided in the normal mode is provided.

The processor 100 may generally control the display system 10. The processor 100 may generate image data MIDT and AIDT to be displayed on the display panel 300, and transmit image data MIDT and AIDT, time information TI, and a command, for example a mode change command MCMD, to the display driver IC 200.

The processor 100 may be an application processor. However, embodiments are not limited thereto, and the processor 100 may be implemented with various types of processors such as a Central Processing Unit (CPU), a microprocessor, a multimedia processor, and a graphics processor. In an exemplary embodiment, the processor 100 may be implemented as an Integrated Circuit (IC), and may be implemented as a mobile Application Processor (AP) or a System on Chip (SoC). The processor 100 may identify whether to change the display system 10 from the normal mode to the AOD mode, or determine whether to change the display system 10 from the AOD mode to the normal mode.

For example, the processor 100 may monitor whether a user input is detected during a specified time, maintain the normal mode based on identifying that the user input is detected during the specified time, and change the mode to the AOD mode based on identifying that no user input is detected for the specified time. As another example, the processor 100 may monitor whether a user input for deactivating the display panel 300 is detected, and change the mode from the normal mode to the AOD mode based on confirming that the user input for deactivating the display panel 300 is detected.

The processor 100 may transmit a mode change command MCMD for mode change to the display driver IC 200. The display driver IC 200 may operate by changing a mode from a normal mode to an AOD mode, or may operate by changing a mode from an AOD mode to a normal mode in response to the mode change command MCMD.

The display driver IC 200 may convert the image data MIDT and AIDT received from the processor 100 into image signals IS for driving the display panel 300, and supply the image signals IS to the display panel 300, thereby displaying an image on the display panel 300. In the normal mode, the display driver IC 200 may receive main image data MIDT, which may be full frame image data corresponding to an entirety or an entire area of the display panel 300, from the processor 100, and receive additional image data AIDT corresponding to a partial area of the display panel 300. In the AOD mode, the display driver IC 200 may receive main image data MIDT, which may be background image data, from the processor 100, and receive additional image data AIDT corresponding to an AOD area 310 of the display panel 300.

The display driver IC 200 may include an AOD mode controller 230. In an exemplary embodiment, the AOD mode controller 230 may perform the AOD mode using main image data MIDT, additional image data AIDT, and time information TI. For example, the AOD mode controller 230 may use the main image data MIDT, the additional image data AIDT, and the time information TI to generate control signals so that the AOD image combined with the background image and the additional image is displayed on the display panel 300.

The display panel 300 may be a display, for example a display unit, on which an actual image is displayed, and may be one of display devices that receive an electrically transmitted image signal IS and display a 2D image, for example, a Thin Film Transistor-Liquid Crystal Display (TFT-LCD), an Organic Light Emitting Diode (OLED) display, a field emission display, a Plasma Display Panel (PDP), and the like. The display panel 300 may be implemented as another type of a flat panel display or a flexible display panel. In the AOD mode, an image may be displayed on the AOD area 310 of the display panel 300. In an exemplary embodiment, the AOD area 310 may be a partial area of the display panel 300. For example, the AOD area 310 may be an area in which an image is displayed when the display system 10 operates in an AOD mode or a low power mode. The AOD area 310 may be not a fixed area on the display panel 300, and the position, size, number, and the like of the AOD area 310 on the display panel 300 may change according to time or driving conditions.

The display driver IC 200 according to an exemplary embodiment of the present disclosure may store the additional image data received in the AOD mode in a memory in which the additional image data received in the normal mode is stored. Accordingly, it is possible to prevent an increase in cost due to the use of a dedicated memory by not including a separate memory for performing the AOD mode.

In addition, the display driver IC 200 may receive encoded background image data in a normal mode, and may receive unencoded background image data in an AOD mode. The display driver IC may not perform a decoding operation on the background image data in the AOD mode, so that power consumption required for the decoding operation may be reduced.

Figure 2:
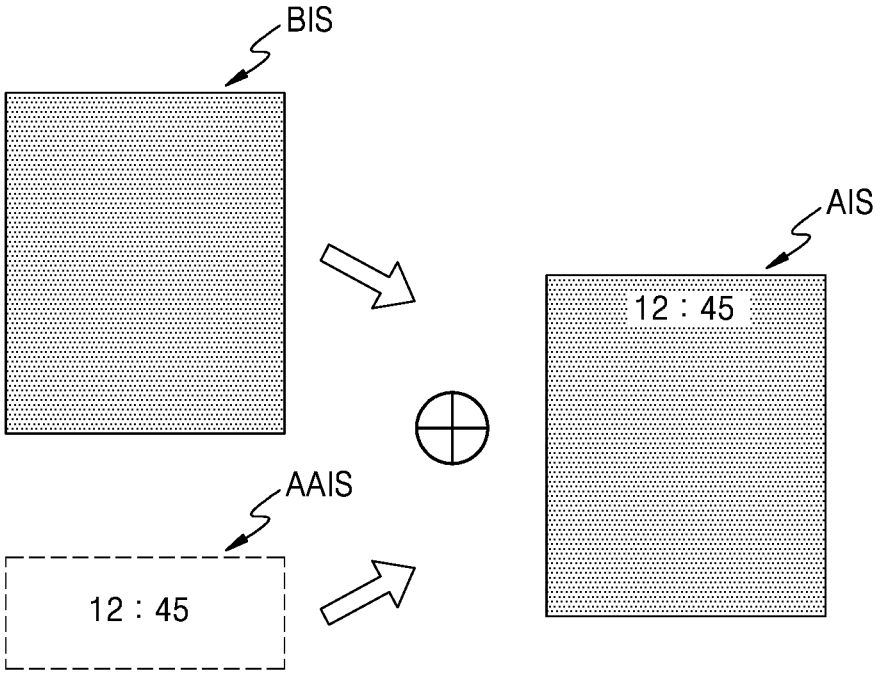
FIG. 2 is a diagram for describing an image displayed on the display panel according to a signal received from a display driving circuit by a display panel according to an embodiment.

FIG. 2 is a diagram for describing an image displayed on the display panel according to a signal received from a display driver IC by a display panel according to an exemplary embodiment of the present disclosure.

Referring to FIGS. 1 and 2, the display panel 300 may receive an AOD image signal AIS from the display driver IC 200. The AOD image signal AIS may include a background image signal BIS and an additional image signal AAIS, and may be a combination of the background image signal BIS and the additional image signal AAIS. The display panel 300 may display an actual image according to the AOD image signal AIS. The additional image according to the additional image signal AAIS may be, for example, a clock. In FIG. 2, the image according to the additional image signal AAIS is illustrated as a digital clock, but embodiments are not limited thereto, and in FIG. 2, the image according to the additional image signal AAIS may be an analog clock.

For example, in the AOD mode, the AOD mode controller 230 may generate control signals so that an additional image in the shape of a digital clock is displayed on the display panel 300 using the additional image data AIDT including information on the font of numbers and/or the font of a colon (:) and the time information TI including current time information. In embodiments, for example, in the AOD mode, the AOD mode controller 230 may generate control signals such that an additional image in the shape of an analog clock is displayed on the display panel 300 using the additional image data AIDT including information on the shape of the hour hand, minute hand, and second hand and the time information TI including current time information.

Figure 3:
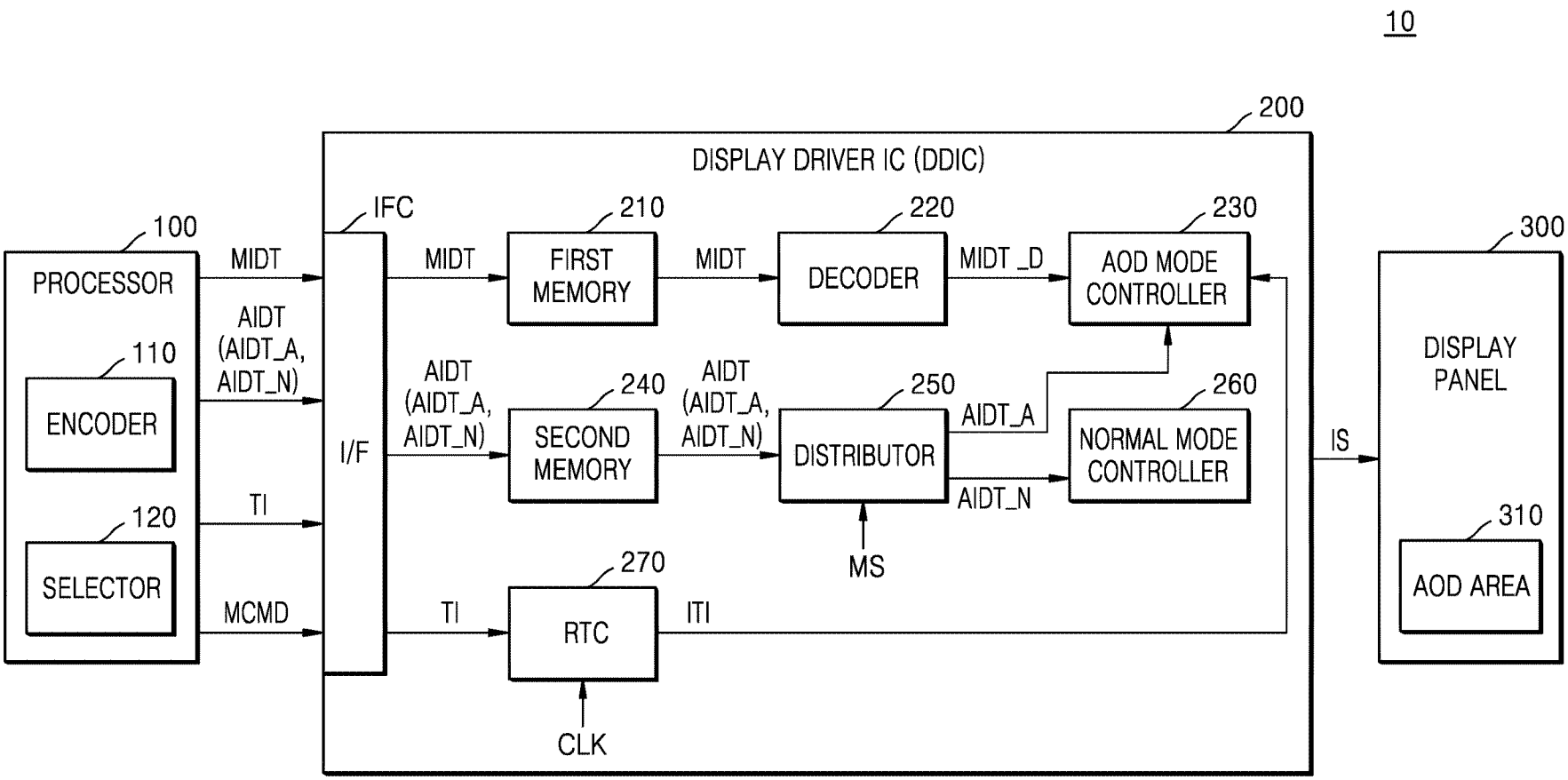
FIG. 3 is a block diagram illustrating a display system according to an embodiment.

FIG. 3 is a block diagram illustrating a display system 10 according to an exemplary embodiment of the present disclosure, which may correspond to the display system 10 of FIG. 1.

Referring to FIG. 3, the display system 10 may include a processor 100, a display driver IC 200, and a display panel 300. The processor 100 may include an encoder 110 and a selector 120. The main image data MIDT compressed by encoding by the encoder 110 may be outputted from the processor 100. The processor 100 may transmit the additional image data AIDT, and by the selection operation of the selector 120, the processor 100 may transmit the first additional image data AIDT_N in the normal mode, and transmit the second additional image data AIDT_A in the AOD mode. In an exemplary embodiment, the selector 120 may be implemented as a multiplexer, and may be configured such that an output signal is changed as the operation mode is changed.

The display driver IC 200 may receive main image data MIDT and additional image data AIDT from the processor 100, and convert the main image data MIDT and the additional image data AIDT into image signals IS for driving the display panel 300. By supplying the image signals IS to the display panel 300, an image may be displayed on the display panel 300. For example, an image of the display panel 300 according to the first additional image data AIDT_N may mean an image displayed in a round corner display area of the display panel 300. Also, for example, the image of the display panel 300 according to the second additional image data AIDT_A may refer to an additional image displayed on the AOD area 310 of the display panel 300.

The display driver IC 200 may include an interface (I/F) circuit IFC, a first memory 210, a decoder 220, an AOD mode controller 230, a second memory 240, a distributor 250, a normal mode controller 260, and an internal time information generation circuit 270, which may relate to, for example, a real-time clock (RTC). The AOD mode controller 230 may be a control logic circuit for performing the AOD mode, and the normal mode controller 260 may be a control logic circuit for performing the normal mode. However, FIG. 3 shows an exemplary configuration of the display driver IC 200, and the display driver IC 200 may further include other components not shown in FIG. 3. In embodiments, the display driver IC 200 may not include one or more components of the interface circuit IFC, the first memory 210, the decoder 220, the AOD mode controller 230, the second memory 240, the distributor 250, the normal mode controller 260, and the internal time information generation circuit 270 shown in FIG. 3.

The interface circuit IFC may receive main image data MIDT, additional image data AIDT, time information TI, and a mode change command MCMD from the processor 100 through a channel. The interface circuit IFC may transmit main image data MIDT, additional image data AIDT, time information TI, and a mode change command MCMD to other components inside the display driver IC 200.

In an exemplary embodiment, the interface circuit IFC may support an RGB interface, a CPU interface, a serial interface, a Mobile Display Digital Interface (MDDI), an Inter Integrated Circuit (I2C) interface, a Serial Peripheral Interface (SPI), a Microcontroller Unit (MCU) interface, a Mobile Industry Processor Interface (MIPI), an embedded Display Port (eDP) interface, a D-subminiature (D-sub) interface, an optical interface, a High Definition Multimedia Interface (HDMI), and the like. In addition, in an exemplary embodiment, the interface circuit IFC may support a Mobile High-definition Link (MHL) interface, a secure Digital (SD) card/Multi-Media Card (MMC) interface, or an Infrared Data Association (IrDA) standard interface.

In an exemplary embodiment, when the mode is changed from the normal mode to the AOD mode, the interface circuit IFC may receive main image data MIDT, additional image data AIDT, and time information TI, and then block a channel connected to the processor 100 for a predetermined time.

The first memory 210 may store the main image data MIDT received through the interface circuit IFC and may transmit the main image data MIDT to the decoder 220. The decoder 220 may decode the main image data MIDT and may transmit the decoded main image data MIDT_D as background image data to the AOD mode controller 230 in the AOD mode. In embodiments, although not shown in FIG. 3, the decoder 220 may transmit the decoded main image data MIDT_D as full frame image data to the normal mode controller 260 in the normal mode.

The second memory 240 may store the additional image data AIDT received through the interface circuit IFC and transmit the additional image data AIDT to the distributor 250. The second memory 240 may store the first additional image data AIDT_N in the normal mode and transmit the first additional image data AIDT_N to the distributor 250. In embodiments, the second memory 240 may store the second additional image data AIDT_A in the AOD mode and transmit the second additional image data AIDT_A to the distributor 250.

The first memory 210 and the second memory 240 may include volatile and/or nonvolatile memory, and for example, each of the first memory 210 and the second memory 240 may include at least one of a volatile memory, for example dynamic random access memory (DRAM), static random access memory (SRAM), or synchronous DRAM (SDRAM), and a nonvolatile memory, for example programmable read-only memory (PROM), erasable PROM (EPROM), flash read-only memory (ROM), or flash memory). In an exemplary embodiment, the first memory 210 may be graphics random access memory (GRAM), and the second memory 240 may be SRAM.

The distributor 250 may transmit the received additional image data AIDT to one of the AOD mode controller 230 and the normal mode controller 260 in response to the mode selection signal MS. The mode selection signal MS may be a signal that is changed according to the mode change command MCMD. The distributor 250 may transmit the first additional image data AIDT_N to the normal mode controller 260 in the normal mode in response to the mode selection signal MS, and transmit the second additional image data AIDT_A to the AOD mode controller 230 in the AOD mode. In an exemplary embodiment, the distributor 250 may be implemented as a demultiplexer, and may transmit signals to be outputted in different configurations as the operation mode is changed.

The internal time information generation circuit 270 may receive time information TI through an interface circuit IFC. In the AOD mode, the internal time information generation circuit 270 may generate internal time information ITI according to the time information TI and the clock signal CLK. The internal time information generation circuit 270 may transmit internal time information ITI to the AOD mode controller 230.

In an exemplary embodiment, the display driver IC 200 may include an oscillator that generates a clock signal CLK. The internal time information generation circuit 270 may generate internal time information ITI using a clock signal CLK generated inside the display driver IC 200.

In an exemplary embodiment, when the processor 100 changes from the normal mode to the AOD mode, the processor 100 may transmit time information TI to the display driver IC 200, and in the AOD mode for a predetermined time thereafter, the display driver IC 200 may block reception of the time information TI. Accordingly, the internal time information generation circuit 270 may continuously update the internal time information ITI by using the clock signal CLK based on the received time information TI.

The AOD mode controller 230 may receive the decoded main image data MIDT_D as background image data from the decoder 220, receive the second additional image data AIDT_A from the distributor 250, and receive the internal time information ITI from the internal time information generation circuit 270. The AOD mode controller 230 may perform an AOD mode operation using the decoded main image data MIDT_D, the second additional image data AIDT_A, and the internal time information ITI. In embodiments, the AOD mode controller 230 uses the main image data MIDT_D, the second additional image data AIDT_A, and the internal time information ITI to generate control signals, for example CTRL1 and CTRL2 in FIG. 4, so that an AOD image is displayed on the display panel 300.

The normal mode controller 260 may receive main image data MIDT_D as full frame image data from the decoder 220 and may receive first additional image data AIDT_N from the distributor 250. The normal mode controller 260 may perform a normal mode using the main image data MIDT_D and the first additional image data AIDT_N. Because the normal mode controller 260 and the AOD mode controller 230 operate in different operation modes, they can operate exclusively with each other. In other words, the normal mode controller 260 may not operate in the AOD mode, and the AOD mode controller 230 may not operate in the normal mode.

In the display driver IC 200 according to the present disclosure, controllers operating exclusively with each other, for example, the AOD mode controller 230 and the normal mode controller 260, may share the second memory 240, which is the same memory. In embodiments according to the AOD mode or the normal mode, the second memory 240 may store the second additional image data AIDT_A used in the AOD mode controller 230, or store the first additional image data AIDT_N used in the normal mode controller 260. Therefore, the display driver IC 200 may not include a separate memory for storing the second additional image data AIDT_A when operating in the AOD mode, so that an increase in cost due to the use of dedicated memory may be prevented.

Figure 4:
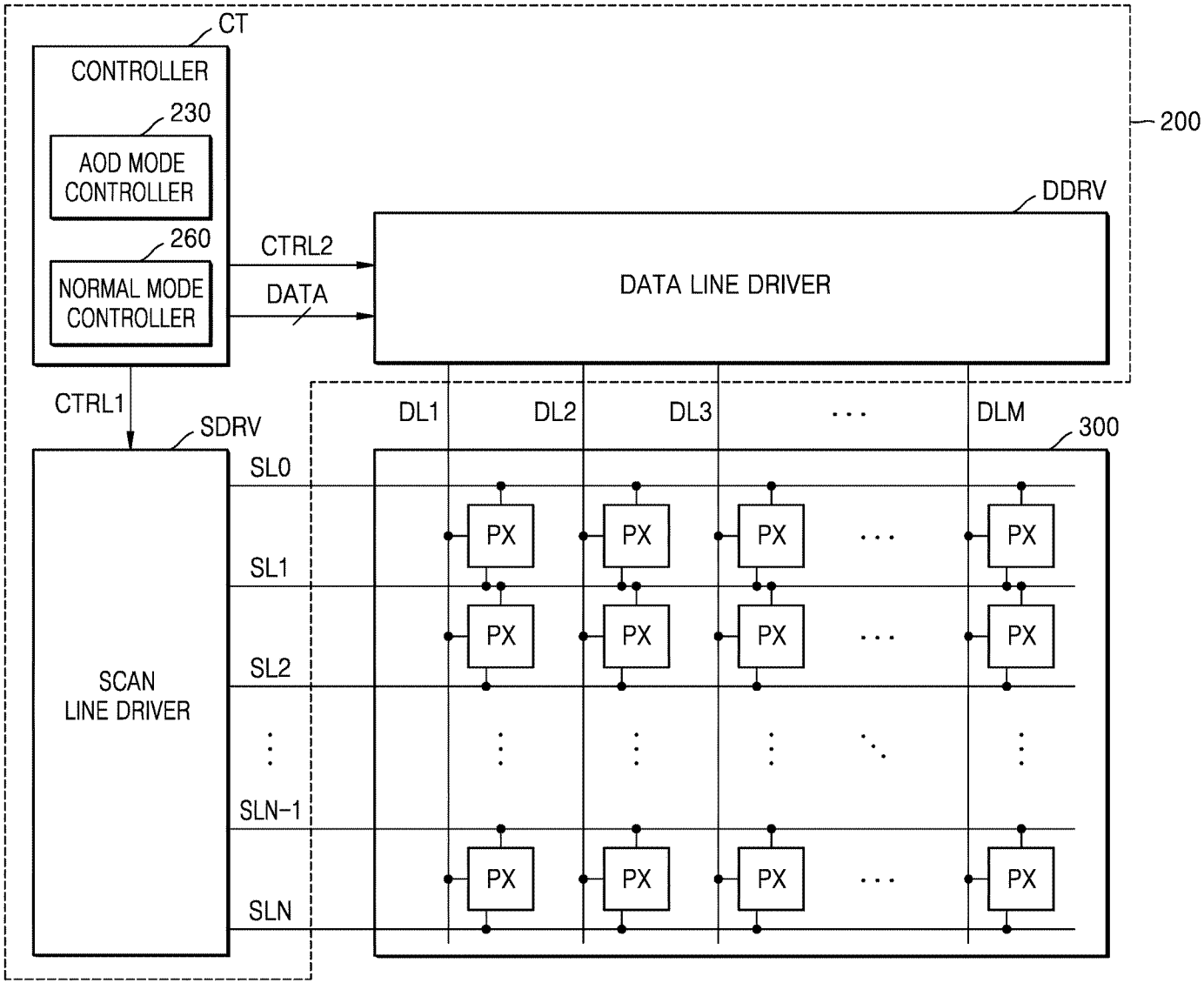
FIG. 4 is a block diagram illustrating a display device according to an embodiment.

FIG. 4 is a block diagram illustrating a display device according to an exemplary embodiment of the present disclosure.

Referring to FIG. 4, the display device may include a display driver IC 200 and a display panel 300, and the display driver IC 200 may include a controller CT, a data line driver DDRV, and a scan line driver SDRV. However, in embodiments the display driver IC 200 may not include the scan line driver SDRV, and the scan line driver SDRV may be included in the display system 10 as a separate component from the display driver IC 200.

The display panel 300 may include a plurality of pixels PX arranged in a matrix form, and each of the plurality of pixels PX outputs a visual signal to display an image in frame units. The display panel 300 includes scan lines SL0 to SLN arranged in a row direction, data lines DL1 to DLM arranged in a column direction, the scan lines SL0 to SLN, and pixels PX formed at intersections of the scan lines SL0 to SLN and the data lines DL1 to DLM. The display panel 300 includes a plurality of horizontal lines (or rows), and one horizontal line includes pixels PX connected to one gate line.

The scan line driver SDRV sequentially supplies a gate on signal to the scan lines SL0 to SLN in response to the first control signal CTRL1 provided from the controller CT, so that the scan lines SL0 to SLN may be sequentially selected. In response to the gate on signal outputted from the scan line driver SDRV, the scan lines SL0 to SLN are sequentially selected, and by applying a gradation voltage corresponding to the pixels PX to the pixels PX connected to the selected scan line through the data lines DL1 to DLM, a display operation may be performed. During a period in which the gate-on signal is not supplied to the scan lines SL0 to SLN, a gate off signal, for example a gate voltage of a logic high level, may be supplied to the scan lines SL0 to SLN.

In response to the second control signal CTRL2, the data line driver DDRV may convert the image data DATA into image signals that are analog signals and provide the image signals to the data lines DL1 to DLM. The data line driver DDRV may include a plurality of channel amplifiers, and each of the plurality of channel amplifiers may provide image signals to at least one corresponding data line.

The controller CT may control all operations of the display system 10. The controller CT may be implemented with hardware, software, or a combination of hardware and software, and for example, the controller CT may be implemented with digital logic circuits and registers that perform various functions below. The controller CT may include an AOD mode controller 230 and a normal mode controller 260 operating in different operation modes. In an exemplary embodiment, the normal mode controller 260 of FIG. 4 may correspond to the normal mode controller 260 of FIGS. 3 and 5 and the normal mode controller 260B of FIG. 6. In an exemplary embodiment, the AOD mode controller 230 of FIG. 4 may correspond to the AOD mode controller 230 of FIGS. 3 and 5, the AOD mode controller 230B of FIG. 6, the AOD mode controller 230C of FIG. 8, the AOD mode controller 230D of FIG. 9, and the AOD mode controller 230E of FIG. 10.

The AOD mode controller 230 may perform an AOD mode operation using the main image data MIDT, the second additional image data AIDT_A, and the internal time information ITI. In embodiments the AOD mode controller 230 uses the main image data MIDT_D, the second additional image data AIDT_A, and the internal time information ITI to generate the control signals CTRL1 and CTRL2 so that an AOD image is displayed on the display panel 300.

Figure 5:
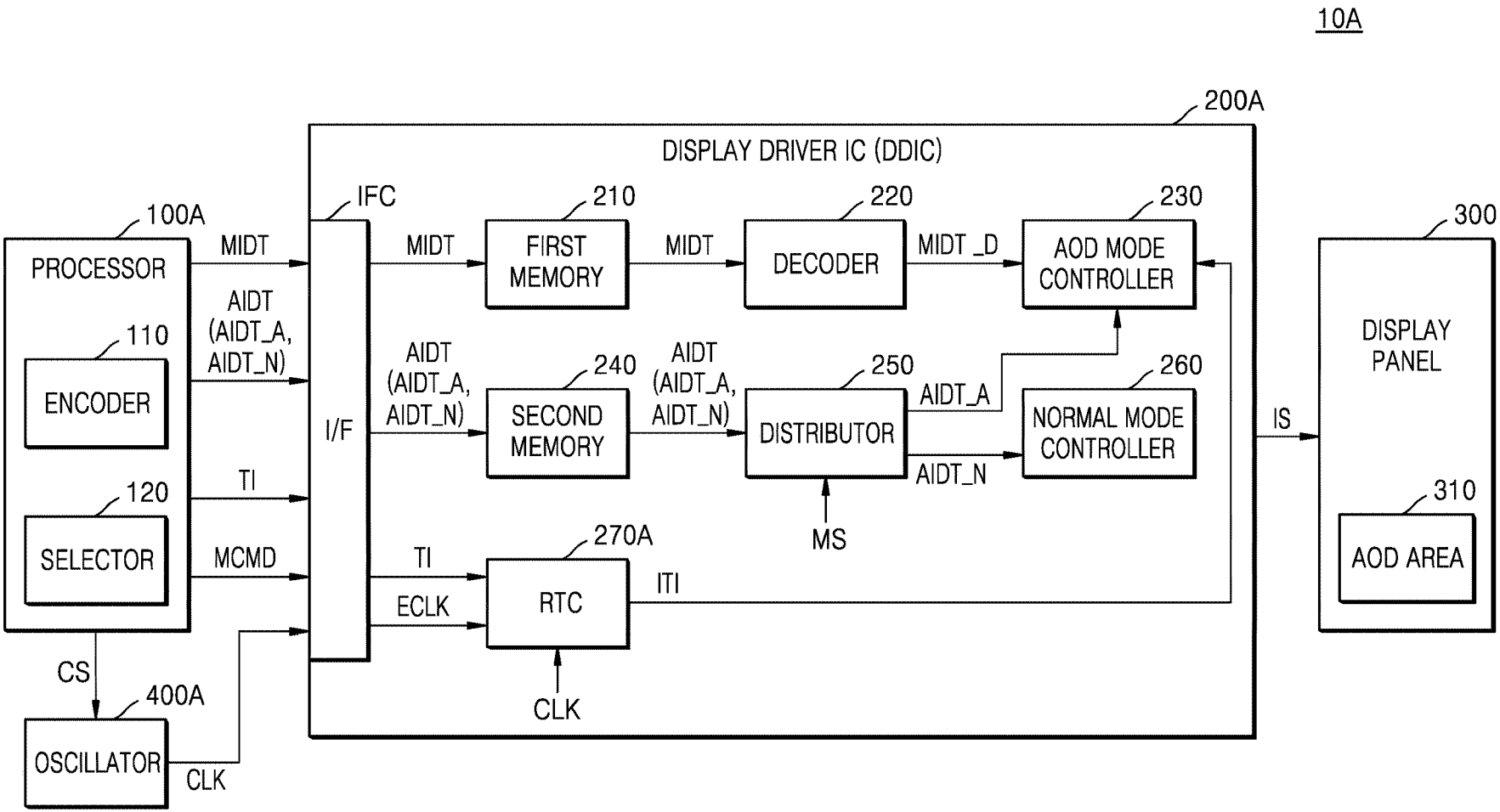
FIG. 5 is a block diagram illustrating a display system according to an embodiment.

FIG. 5 is a block diagram illustrating a display system 10A according to an exemplary embodiment of the present disclosure. In embodiments, display system 10A may correspond to display system 10 of FIG. 1. In the description of FIG. 5, duplicate descriptions of the same reference numerals as in FIG. 3 will be omitted.

Referring to FIG. 5, a display system 10A may include a processor 100A, a display driver IC 200A, a display panel 300, and an oscillator 400A. The oscillator 400A may generate a clock signal CLK and transmit the clock signal CLK to the display driver IC 200A. In embodiments, display driver IC 200A may be a display driving circuit.

In an exemplary embodiment, the oscillator 400A may be a component included in a sensor hub included in the display system 10A. The sensor hub may include at least one sensor and a controller that controls at least one sensor. The sensor hub may include, for example, a temperature/humidity sensor, a biometric sensor, an atmospheric pressure sensor, a gyro sensor, and the like.

The display driver IC 200A may include an internal time information generation circuit 270A, and the internal time information generation circuit 270A may receive the clock signal CLK generated by the oscillator 400A outside the display driver IC 200A. For example, the internal time information generation circuit 270A may receive a clock signal CLK through an interface circuit IFC. The internal time information generation circuit 270A may generate internal time information ITI by using the clock signal CLK, and provide the internal time information ITI to the AOD mode controller 230. The AOD mode controller 230 may provide image signals IS to the display panel 300 so that an additional image is displayed on the display panel 300 based on the internal time information ITI.

In an exemplary embodiment, the oscillator 400A may generate a clock signal CLK in response to the control signal CS received from the processor 100A and transmit the clock signal CLK to the display driver IC 200A. When the mode is changed from the normal mode to the AOD mode, the processor 100A may transmit a control signal CS to the oscillator 400A, and as the AOD mode is performed, the oscillator 400A may generate a clock signal CLK. In embodiments, the oscillator 400A may not generate the clock signal CLK in the normal mode.

In an exemplary embodiment, the oscillator 400A may generate the clock signal CLK by performing the normal mode and the AOD mode, and may transmit the clock signal CLK to the display driver IC 200A. The display driver IC 200A may generate internal time information ITI using an internal clock signal generated by an oscillator included in the display driver IC 200A in the normal mode, and generate internal time information ITI by using the clock signal CLK generated by the external oscillator 400A in the AOD mode.

Compared to including an oscillator that generates a clock signal inside the display driver IC 200A, when the display driver IC 200A uses an external clock signal CLK in the AOD mode, the internal time information ITI may be generated using a clock signal CLK generated by an oscillator with relatively high performance. The display driver IC 200A according to an exemplary embodiment of the present disclosure generates internal time information ITI using the clock signal ECLK generated by the oscillator 400A outside the display driver IC 200A, so that a number of wake-up operations in which the processor 100A periodically transmits the time information TI in order to improve the accuracy of the internal time information ITI may be reduced. Accordingly, power consumption of the display driver IC according to the wake up operation may be reduced.

Figure 6:
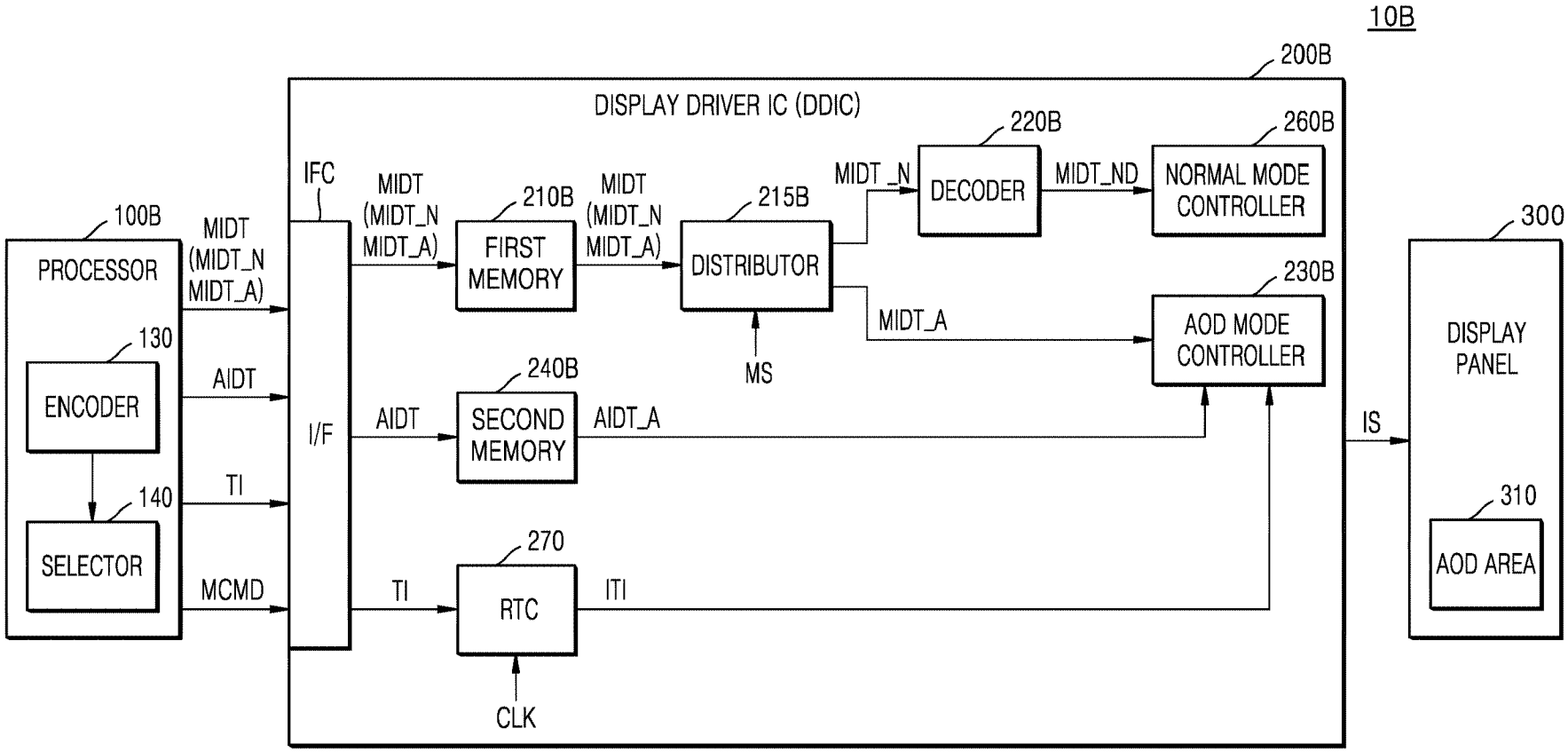
FIG. 6 is a block diagram illustrating a display system according to an embodiment.

FIG. 6 is a block diagram illustrating a display system 10B according to an exemplary embodiment of the present disclosure. In embodiments, display system 10B may correspond to display system 10 of FIG. 1. In the description of FIG. 6, duplicate descriptions of the same reference numerals as in FIG. 3 will be omitted.

Referring to FIG. 6, a display system 10B may include a processor 100B, a display driver IC 200B, and a display panel 300. In embodiments, display driver IC 200B may be a display driving circuit. The processor 100B may include an encoder 130 and a selector 140. In an exemplary embodiment, the selector 140 may be implemented as a multiplexer, and may be configured such that an output signal is changed as the operation mode is changed.

The processor 100B may transmit the first main image data MIDT_N encoded through the encoder 130 to the display driver IC 200B in the normal mode. In embodiments, in the AOD mode, the processor 100B may transmit unencoded, or for example uncompressed, second main image data MIDT_A, to the display driver IC 200B without passing through the encoder 130. The first main image data MIDT_N may be full frame image data of the display panel 300, and the second main image data MIDT_A may mean background image data for displaying a background image on the display panel 300 in the AOD mode.

For example, in the normal mode, the selector 140 may select and output the compressed internal main image data received from the encoder 130, and the processor 100B may transmit the compressed internal main image data as first main image data MIDT_N to the display driver IC 200B. In the AOD mode, the selector 140 may select and output uncompressed internal main image data that is not through the encoder 130, and the processor 100B may transmit uncompressed internal main image data as second main image data MIDT_A to the display driver IC 200B.

The processor 100B may extract only a significant area of the background image, for example a ⅓ area of the entire area, in the AOD mode, and transmit the background image data corresponding to the extracted area to the display driver IC 200B as the second main image data MIDT_A in an uncompressed state without passing through the encoder 130. For example, the size of the data corresponding to the extracted significant area may be determined according to the bandwidth of a channel for transmitting the main image data MIDT from the processor 100B to the display driver IC 200B.

The processor 100B may transmit the additional image data AIDT to the display driver IC 200B. In an exemplary embodiment, as described in FIG. 3, the processor 100B may transmit the first additional image data, for example AIDT_N in FIG. 3, in the normal mode, and may transmit the second additional image data, for example AIDT_A of FIG. 3, in the AOD mode.

The display driver IC 200B may receive main image data MIDT and additional image data AIDT received from the processor 100B, and convert the main image data MIDT and the additional image data AIDT into image signals IS for driving the display panel 300. By supplying the image signals IS to the display panel 300, an image may be displayed on the display panel 300.

The display driver IC 200B includes an interface circuit IFC, a first memory 210B, a distributor 215B, a decoder 220B, a normal mode controller 260B, an AOD mode controller 230B, a second memory 240B, and an internal time information generation circuit 270. The AOD mode controller 230B may be a control logic circuit for performing the AOD mode, and the normal mode controller 260B may be a control logic circuit for performing the normal mode.

The first memory 210B may store the main image data MIDT received through the interface circuit IFC and transmit the main image data MIDT to the distributor 215B. The first memory 210B may store the first main image data MIDT_N in the normal mode, and may store the second main image data MIDT_A in the AOD mode.

The distributor 215B may transmit the received main image data MIDT to one of the AOD mode controller 230B and the normal mode controller 260B in response to the mode selection signal MS. The mode selection signal MS may be a signal that is changed according to the mode change command MCMD. The distributor 215B may transmit the first main image data MIDT_N to the decoder 220B in the normal mode in response to the mode selection signal MS, and transmit the second main image data MIDT_A to the AOD mode controller 230B in the AOD mode. In an exemplary embodiment, the distributor 215B may be implemented as a demultiplexer, and may transmit signals to be outputted in different configurations as the operation mode is changed.

The decoder 220B may decode the first main image data MIDT_N and transmit the decoded first main image data MIDT_ND as full frame image data to the normal mode controller 260B.

The second memory 240B may store the additional image data AIDT transmitted from the processor 100B and transmit the additional image data AIDT to the AOD mode controller 230B. In an exemplary embodiment, as described in FIG. 3, the second memory 240B may store first additional image data, for example AIDT_N in FIG. 3, in the normal mode, and store second additional image data, for example AIDT_A in FIG. 3, in the AOD mode. In an exemplary embodiment, the first memory 210B may be GRAM, and the second memory 240B may be SRAM.

The internal time information generation circuit 270 may receive time information TI through an interface circuit IFC. In the AOD mode, the internal time information generation circuit 270 may generate internal time information ITI according to the time information TI and the clock signal CLK. The clock signal CLK may be generated by an oscillator inside the display driver IC 200B, or may be generated by an oscillator outside the display driver IC 200B as described with respect to FIG. 5.

The AOD mode controller 230B may receive the second main image data MIDT_A as background image data from the distributor 215B, receive the additional image data AIDT_A from the second memory 240B, and receive the internal time information ITI from the internal time information generation circuit 270. The AOD mode controller 230B may perform the AOD mode by using the second main image data MIDT_A, the additional image data AIDT_A, and the internal time information ITI.

The second main image data MIDT_A may be data from which data on a portion that is not required to be displayed on the display panel is removed. In an exemplary embodiment, the AOD mode controller 230B may control a data line driver, for example DDRV in FIG. 4 to prevent the display panel 300 from displaying an area determined to be unnecessary for display on the display panel 300 based on the second main image data MIDT_A.

Because the processor 100B transmits the second main image data MIDT_A, which is uncompressed background image data that is not compressed in the AOD mode, the display driver IC 200B may not decode the second main image data MIDT_A, but may process the second main image data MIDT_A directly in the AOD mode controller 230B. The display driver IC 200B according to the present disclosure receives second main image data MIDT_A that is not encoded as background image data in the AOD mode, so that the power consumption required to decode the background image data may be reduced.

Figure 7:
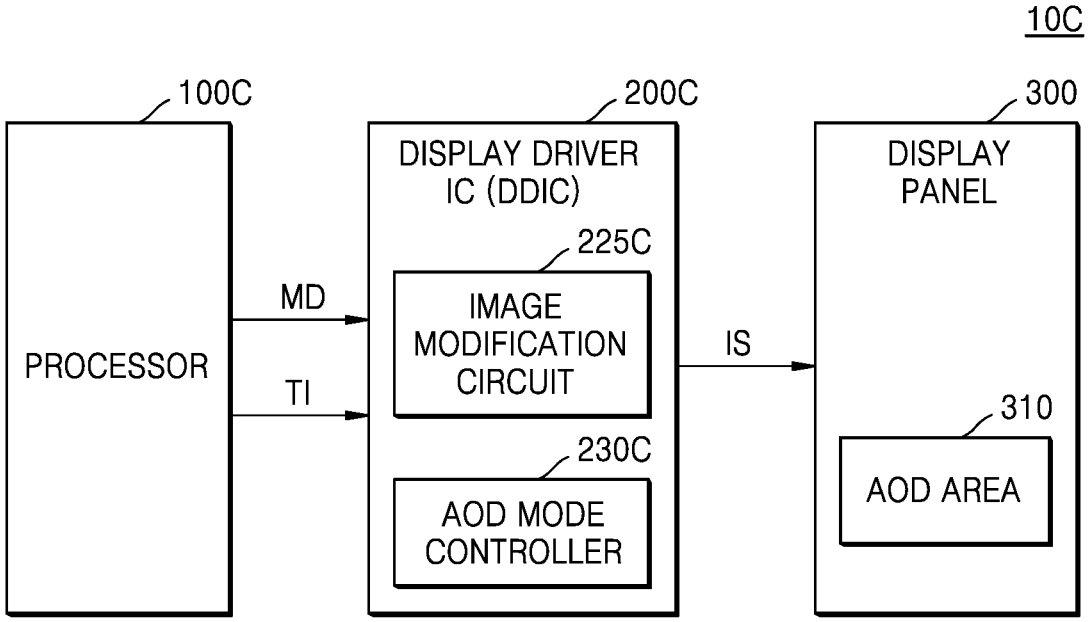
FIG. 7 is a block diagram showing a display system according to an embodiment.

FIG. 7 is a block diagram showing a display system 10C according to an embodiment of the present disclosure.

Referring to FIG. 7, a display system 10C may include a processor 100C, a display driver IC 200C, and a display panel 300. In embodiments, display driver IC 200C may be a display driving circuit. In an exemplary embodiment, the display driver IC 200C and the display panel 300 may be implemented as one module. The display system 10C may operate in a plurality of operation modes, for example, a normal mode and an AOD mode.

The processor 100C may generally control the display system 10C. The processor 100C may generate merged image data MD to be displayed on the display panel 300 in the AOD mode, and transmit the merged image data MD and time information TI to the display driver IC 200C.

The merged image data MD may be data in which main image data which are background image data, and additional image data, are merged. In an exemplary embodiment, when merging main image data and additional information data, the processor 100C may merge additional image data necessary for performing the AOD mode in a data area that is determined to be unnecessary in the main image data, for example, in a data area corresponding to a portion that is black-processed and displayed on the display panel 300 in the AOD mode.

The display driver IC 200C converts the merged image data MD received from the processor 100C in the AOD mode into image signals IS for driving the display panel 300, and supplies the image signals IS to the display panel 300, so that an image may be displayed on the display panel 300.

The display driver IC 200C may include an image modification circuit 225C and an AOD mode controller 230C. The image modification circuit 225C may extract main image data and additional image data from the merged image data MD. The AOD mode controller 230C may drive the display panel 300 to display an image in which a background image and an additional image are combined using main image data and additional image data outputted from the image modification circuit 225C.

Because the display driver IC 200C according to an exemplary embodiment of the present disclosure generates image signals IS for displaying an AOD image on the display panel 300 autonomously within the display driver IC 200C using the merged image data MD transmitted from the processor 100C, the processor 100C may prevent power consumption for transmission of separate additional image data for the AOD mode.

Figure 8:
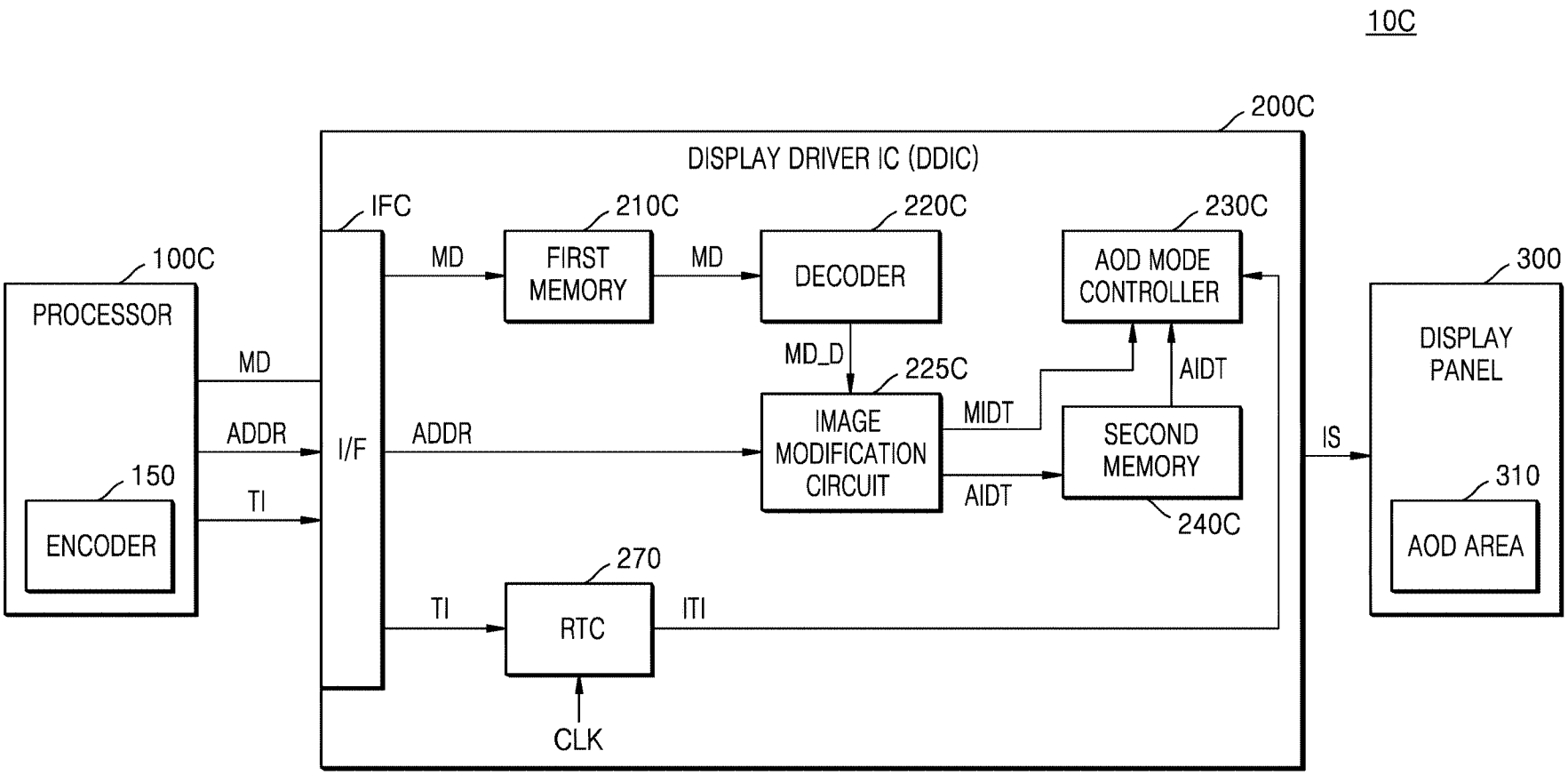
FIG. 8 is a block diagram illustrating a display system according to an embodiment.
Figure 9:
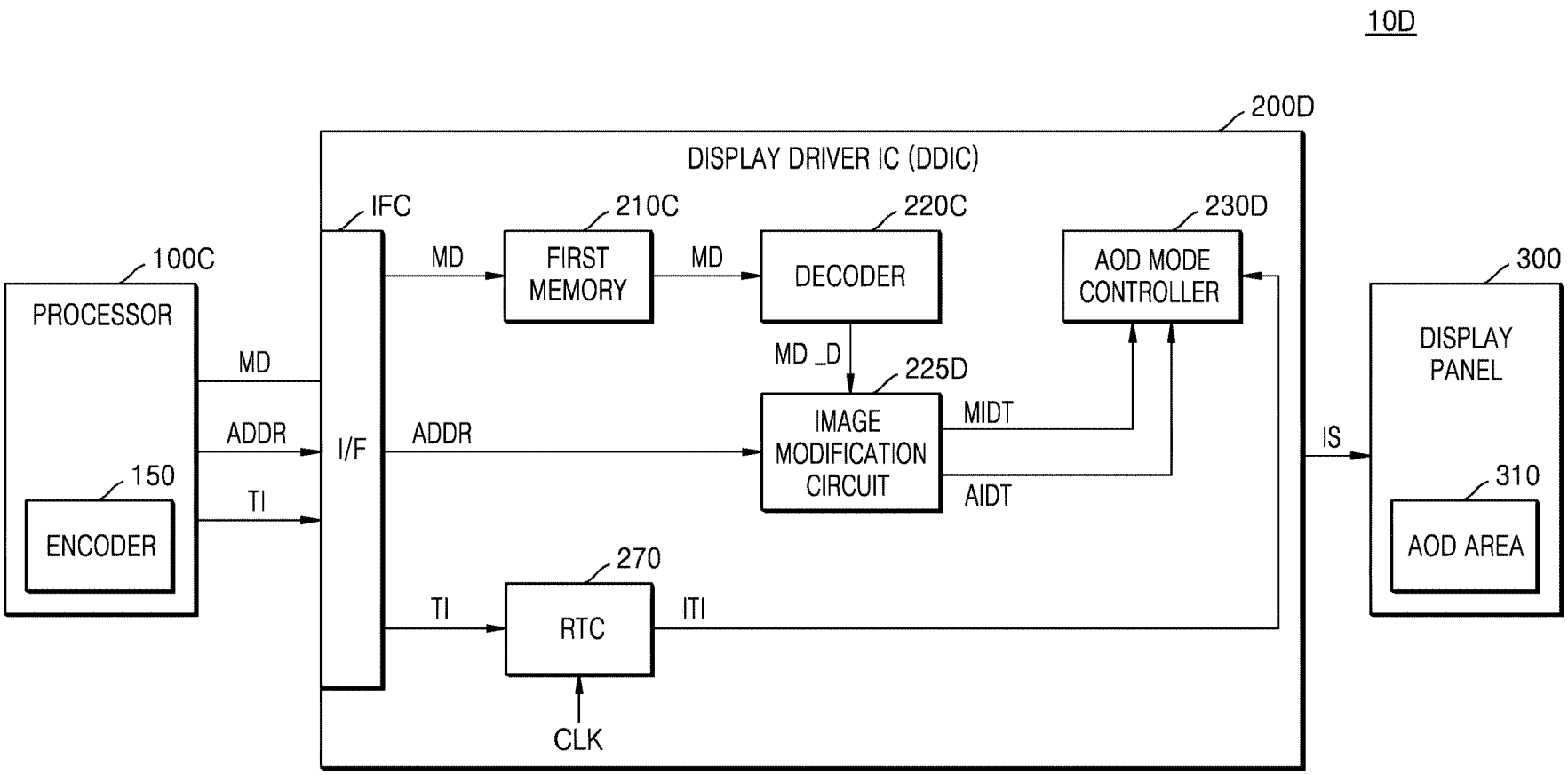
FIG. 9 is a block diagram illustrating a display system according to an embodiment.

FIG. 8 is a block diagram illustrating an example of a display system 10C according to an exemplary embodiment of the present disclosure. FIG. 9 is a block diagram illustrating a display system 10D according to an exemplary embodiment of the present disclosure. In embodiments, display system 10D may correspond to display system 10C of FIG. 7. In FIGS. 8 and 9, redundant descriptions of the same reference numerals as in FIG. 3 will be omitted.

Referring to FIG. 8, a display system 10C may include a processor 100C, a display driver IC 200C, and a display panel 300.

The processor 100C may output merged image data MD in which main image data and additional image data are merged in the AOD mode, and may transmit the merged image data MD to the display driver IC 200C. The processor 100C may transmit an address ADDR indicating the location of the additional image data merged in the merged image data MD to the display driver IC 200C. However, in embodiments the processor 100C may not transmit the address ADDR to the display driver IC 200C, and each of the processor 100C and the display driver IC 200C may have previously agreed, for example determined or set, a position of the additional image data in the merged image data MD. For example, an address ADDR indicating the location of the additional image data in the merged image data MD may be preset in the image modification circuit 225C.

In an exemplary embodiment, the processor 100C may include an encoder 150, and the merged image data MD outputted from the processor 100C may be data encoded to correspond to a bandwidth of a channel connecting the processor 100C to the display driver IC 200C. However, the embodiments are not limited thereto, and if it is determined that compression is not necessary according to the bandwidth of the merged image data MD channel, the processor 100C may output uncompressed merged image data MD.

In an exemplary embodiment, when merging the main image data and additional image data, the processor 100C merges the additional image data necessary for performing the AOD mode into the data area determined to be unnecessary in the main image data, so that merged image data MD may be outputted. In this case, the data area determined to be unnecessary in the main image data may be, for example, a data area corresponding to a portion displayed as black on the display panel 300 in the AOD mode. In embodiments the data area may be an area of the display panel 300 excluding the AOD area 310.

The display driver IC 200C may include an interface circuit IFC, a first memory 210C, a decoder 220C, an image modification circuit 225C, an AOD mode controller 230C, a second memory 240C, and an internal time information generation circuit 270. In an exemplary embodiment, the first memory 210C may be GRAM, and the second memory 240C may be SRAM. In an exemplary embodiment, when the processor 100C transmits uncompressed merged image data MD, the display driver IC 200C may not include the decoder 220C.

The first memory 210C may store the merged image data MD received through the interface circuit IFC and transmit the merged image data MD to the decoder 220C. The decoder 220C may decode merged image data MD, which is compressed data, and transmit the decoded merged image data MD_D to the image modification circuit 225C.

The image modification circuit 225C may extract additional image data AIDT from the decoded merged image data MD_D. The image modification circuit 225C may transmit the additional image data AIDT to the second memory 240C. The second memory 240C may store the additional image data AIDT and may transmit the additional image data AIDT to the AOD mode controller 230C.

In an exemplary embodiment, the image modification circuit 225C may receive the address ADDR through the interface circuit IFC. The image modification circuit 225C may extract the additional image data AIDT from the decoded merged image data MD_D based on the address ADDR. However, in embodiments the display driver IC 200C according to the present disclosure may not separately receive the address ADDR, and an address indicating the location of the additional image data AIDT in the decoded merged image data MD_D may be preset in the display driver IC 200C.

The image modification circuit 225C may set the data area obtained by extracting the additional image data AIDT from the decoded merged image data MD_D as a black processing area to generate main image data MIDT, which is background image data. The image modification circuit 225C may transmit the main image data MIDT to the AOD mode controller 230C.

The internal time information generation circuit 270 may receive time information TI through an interface circuit IFC. In the AOD mode, the internal time information generation circuit 270 may generate internal time information ITI according to the time information TI and the clock signal CLK. The clock signal CLK may be generated by an oscillator inside the display driver IC 200C, or may be generated by an oscillator outside the display driver IC 200C as described with respect to FIG. 5.

The AOD mode controller 230C may drive the display panel 300 to display an AOD image on the display panel 300 using the main image data MIDT, the additional image data AIDT, and the internal time information ITI. The AOD mode controller 230C may provide image signals IS corresponding to the main image data MIDT to the display panel 300, and provide image signals IS corresponding to the additional image data AIDT to the display panel 300.

In this case, the AOD mode controller 230C may modify a part of the additional image data AIDT and then provide image signals IS according to the modified data to the display panel 300. For example, the extracted additional image data AIDT may be modified so that the size, position, or luminance of the additional image, for example an image of a clock indicating time, is changed, or the extracted additional image data AIDT may be modified so that the additional image is moved or rotated.

Because the display driver IC 200C according to the present disclosure configures an AOD image using merged image data MD transmitted from the processor 100C, it is possible to configure a high-quality AOD image compared to configuring an AOD image autonomously in the display driving circuit. Further, because the processor 100C transmits merged image data MD, power consumption may be reduced.

Referring to FIG. 9, compared with the display driver IC 200C of FIG. 8, a display driver IC 200D does not include a second memory, and may include an interface circuit IFC, a first memory 210C, a decoder 220C, an image modification circuit 225D, an AOD mode controller 230D, and an internal time information generation circuit 270. The image modification circuit 225D may extract the additional image data AIDT from the decoded merged image data MD_D and transmit the extracted additional image data AIDT to the AOD mode controller 230D. Therefore, because the display driver IC 200D does not include a separate second memory for storing the additional image data AIDT, there is no need to have a dedicated memory for the AOD mode controller 230D so that the manufacturing cost of the display driver IC 200D may be reduced. In embodiments, display driver IC 200D may be a display driving circuit.

FIGS. 8 and 9 show that the display driver ICs 200C and 200D decode the merged image data MD and then extract the additional image data AIDT from the decoded merged image data MD, but the display driver ICs 200C and 200D according to the present disclosure are not limited thereto. If the received merged image data MD does not need to be decoded, the display driver ICs 200C and 200D may extract the additional image data AIDT without decoding the received merged image data MD. In embodiments, the display driver ICs 200C and 200D may perform a decoding operation after extracting main image data and additional image data from the received merged image data MD.

Figure 10:
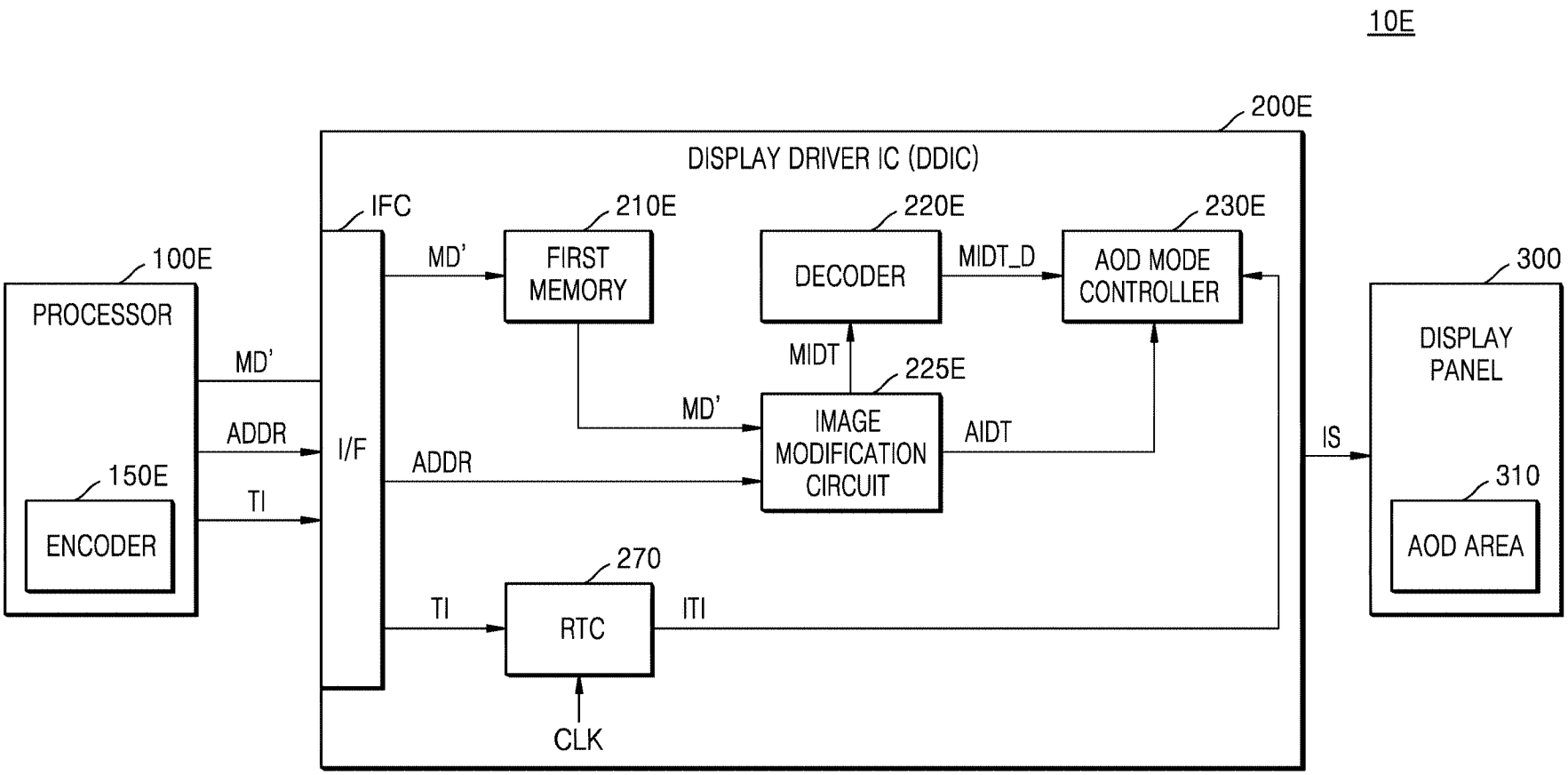
FIG. 10 is a block diagram illustrating a display system according to an embodiment.

FIG. 10 is a block diagram illustrating a display system 10E according to an exemplary embodiment of the present disclosure. In embodiments, display system 10E may correspond to display system 10C of FIG. 7. In FIG. 10, redundant descriptions of the same reference numerals as in FIGS. 3 and 8 will be omitted.

Referring to FIG. 10, a display system 10E may include a processor 100E, a display driver IC 200E, and a display panel 300. In embodiments, display driver IC 200E may be a display driving circuit.

The processor 100E may output merged image data MD' in which main image data and additional image data are merged in the AOD mode, and may transmit the merged image data MD' to the display driver IC 200E. The processor 100E may transmit an address ADDR indicating the location of the merged additional image data in the merged image data MD' to the display driver IC 200E. However, in embodiments the processor 100E may not transmit the address ADDR to the display driver IC 200E, and each of the processor 100E and the display driver IC 200E may have preset positions of the merged additional image data in the merged image data MD. In an exemplary embodiment, the processor 100E may include an encoder 150E, and after encoding data corresponding to the main image data through the encoder 150E, the processor 100E may merge data corresponding to the additional image data with the encoded data to output merged image data MD'.

The display driver IC 200E may include an interface circuit IFC, a first memory 210E, a decoder 220E, an image modification circuit 225E, an AOD mode controller 230E, and an internal time information generation circuit 270. The first memory 210E may store the merged image data MD' received through the interface circuit IFC and transmit the merged image data MD' to the image modification circuit 225E.

The image modification circuit 225E may extract the additional image data AIDT from the merged image data MD'. The image modification circuit 225E may transmit the additional image data AIDT to the AOD mode controller 230E. The image modification circuit 225E may set the data area obtained by extracting the additional image data AIDT from the merged image data MD' as a black processing area, for example an area displayed as black, to generate main image data MIDT, which is background image data. The image modification circuit 225E may transmit the main image data MIDT to the decoder 220E. The decoder 220E may decode the main image data MIDT and may transmit the decoded main image data MIDT_D as background image data to the AOD mode controller 230E in the AOD mode.

The AOD mode controller 230E may drive the display panel 300 to display an AOD image on the display panel 300 using the decoded main image data MIDT_D, the additional image data AIDT, and the internal time information ITI.

Figure 11:
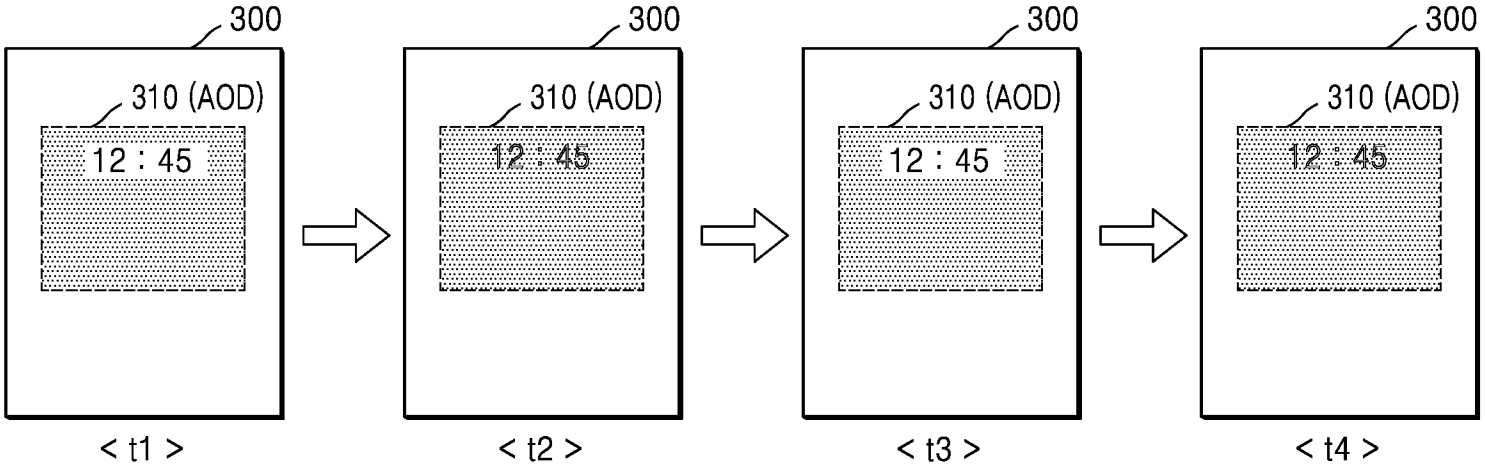
FIG. 11 is a diagram illustrating an operation of a display driving circuit according to an embodiment that adjusts the luminance of an AOD area.

FIG. 11 is a diagram illustrating an operation of a display driving circuit according to an exemplary embodiment of the present disclosure that adjusts the luminance of an AOD area.

Referring to FIG. 11, the display driver ICs 200, 200A, 200B, 200C, 200D, and 200E illustrated in FIGS. 1 to 10 periodically or aperiodically upscale and down scale the pixel data values of a portion to be displayed on the AOD area in order to increase and decrease the luminance of the AOD area 310 periodically or non-periodically with time. Accordingly, the luminance of the AOD area 310 may increase or decrease, for example blink, over time. As shown, the luminance of the AOD area 310 may be high at the time t1 and the time t3, and the luminance of the AOD area 310 may be low at the time t2 and the time t4.

In embodiments, the display driver ICs 200, 200A, 200B, 200C, 200D, and 200E may drive the display panel 300 so that the size or position of the additional image corresponding to the additional image data in the AOD area 310 varies over time. In embodiments, the display driver ICs 200, 200A, 200B, 200C, 200D, and 200E may drive the display panel 300 so that the additional image corresponding to the additional image data in the AOD area 310 is rotated over time.

Figure 12:
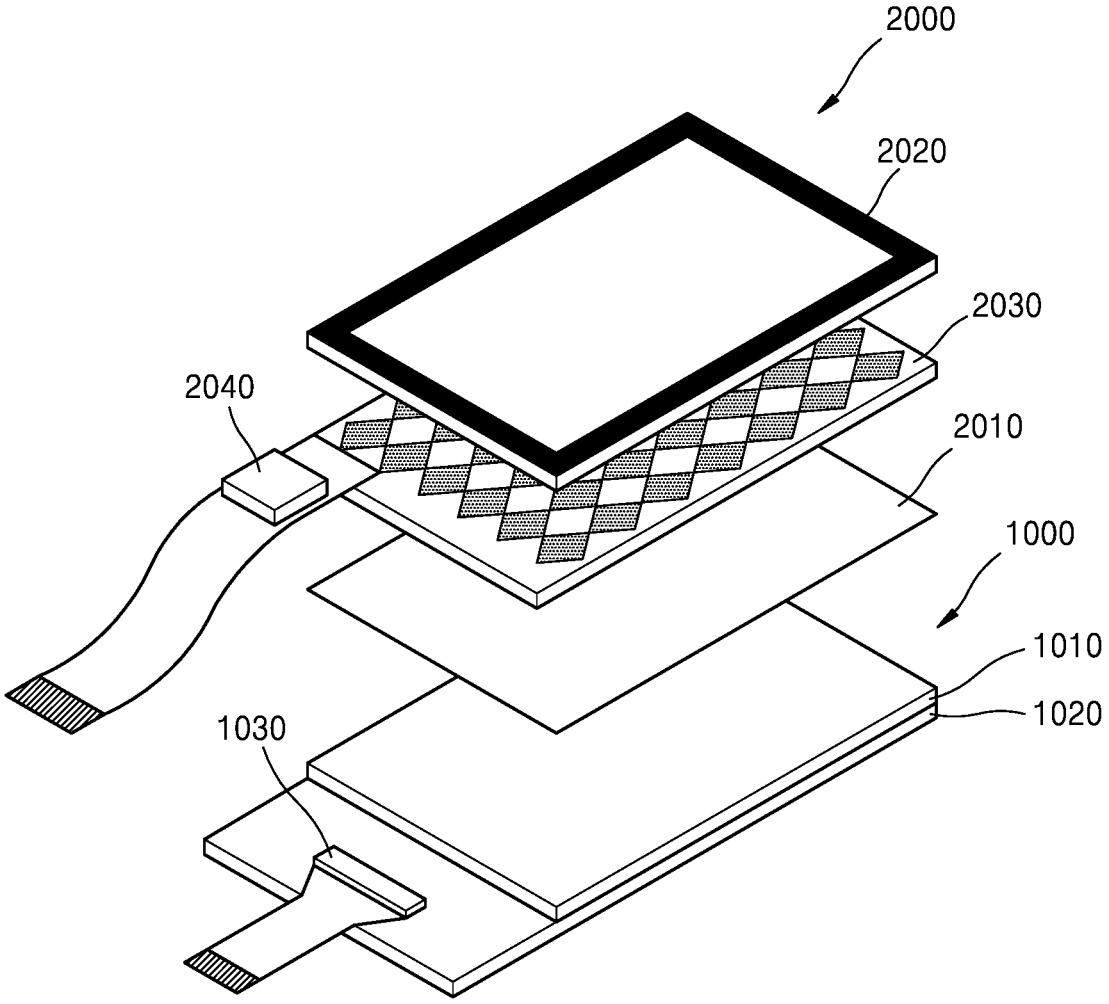
FIG. 12 is a diagram illustrating a touch screen module according to an embodiment.

FIG. 12 is a diagram illustrating a touch screen module according to an exemplary embodiment of the present disclosure.

Referring to FIG. 12, a touch screen module 2000 may include a display device 1000, a polarizing plate 2010, a touch panel 2030, a touch controller 2040, and a window glass 2020. The display device 1000 may include a display panel 1010, a printed board 1020, and a display driving circuit 1030. The display driving circuit 1030 may be the display driver ICs 200, 200A, 200B, 200C, 200D, and 200E according to an embodiment of the present disclosure described with reference to FIGS. 1 to 10.

The window glass 2020 may be made of a material such as acrylic or tempered glass, and may protect the touch screen module 2000 from scratches caused by external impacts or repeated touches. The polarizing plate 2010 may be provided to improve optical properties of the display panel 1010. The display panel 1010 may be formed by patterning a transparent electrode on the printed board 1020. The display panel 1010 may include a plurality of pixels for displaying a frame. The display driving circuit 1030 may operate in a normal mode and an AOD mode. For example, if the user's touch is not detected for a predetermined time, the touch screen module 2000 may change the mode from the normal mode to the AOD mode, and the display driving circuit 1030 may generate image signals such that an AOD image is displayed in the AOD area of the display panel 1010.

The touch screen module 2000 may further include a touch panel 2030 and a touch controller 2040. The touch panel 2030 may be formed by patterning a transparent electrode such as Indium Tin Oxide (ITO) on a glass substrate or a Polyethylene Terephthalate (PET) film. In an exemplary embodiment, the touch panel 2030 may be formed on the display panel 1010. For example, the pixels of the touch panel 2030 may be formed by being merged with the pixels of the display panel 1010. The touch controller 2040 may detect the occurrence of a touch on the touch panel 2030, calculate touch coordinates, and transmit the touch coordinates to the host, for example a processor. The touch controller 2040 may be integrated in one semiconductor chip together with the display driving circuit 1030.

While embodiments have been particularly shown and described, it will be understood that various changes in form and details may be made therein without departing from the spirit and scope of the following claims.

What is claimed is:

1. A display driving circuit for driving a display panel, the display driving circuit comprising:

a first memory configured to store main image data received from outside of the display driving circuit, wherein the main image data corresponds to a background image;

a second memory configured to store first additional image data in a normal mode, and to store second additional image data in an Always On Display (AOD) mode having lower power consumption than the normal mode;

a normal mode controller configured to operate in the normal mode according to the first additional image data stored in the second memory; and an AOD mode controller configured to operate in the AOD mode according to the main image data stored in the first memory and the second additional image data stored in the second memory, wherein the main image data is stored in a compressed form in the first memory, and is decompressed by the display driving circuit before being used, and wherein at least one of the first additional image data and the second additional image data is stored in an uncompressed form in the second memory, and is not decompressed by the display driving circuit before being used.

2. The display driving circuit of claim 1, further comprising an internal time information generation circuit configured to receive a clock signal and time information, and to generate internal time information based on the clock signal and the time information, wherein the AOD mode controller operates in the AOD mode based on the internal time information.

3. The display driving circuit of claim 2, wherein the clock signal is received from the outside of the display driving circuit.

4. The display driving circuit of claim 1, further comprising a distributor configured to:

receive the first additional image data and the second additional image data from the second memory;

transmit the first additional image data to the normal mode controller according to a mode selection signal; and transmit the second additional image data to the AOD mode controller according to the mode selection signal.

5. The display driving circuit of claim 1, further comprising a decoder configured to:

receive the main image data from the first memory;

decode the received main image data; and transmit the decoded main image data to the AOD mode controller.

6. The display driving circuit of claim 1, wherein the normal mode controller does not operate in the AOD mode, and wherein the AOD mode controller does not operate in the normal mode.

7. The display driving circuit of claim 1, wherein the first memory includes graphic random access memory (RAM), and the second memory includes static RAM (SRAM).

8. A display driving circuit for driving a display panel, the display driving circuit comprising:

a first memory configured to store first main image data in a normal mode and second main image data in an Always On Display (AOD) mode having lower power consumption than the normal mode;

a distributor configured to receive the first main image data and the second main image data from the first memory, and distribute the first main image data and the second main image data according to a mode selection signal;

a decoder configured to receive the first main image data from the distributor and decode the received first main image data, and generate the decoded first main image data;

a normal mode controller configured to operate in the normal mode according to the decoded first main image data; and an AOD mode controller configured to receive the second main image data from the distributor without the second main image data passing through the decoder, and to operate in the AOD mode according to the second main image data.

9. The display driving circuit of claim 8, further comprising a second memory configured to store first additional image data in the AOD mode, wherein the AOD mode controller is further configured to operate in the AOD mode according to the second main image data and the first additional image data.

10. The display driving circuit of claim 9, wherein the second memory is further configured to store second additional image data in the normal mode, wherein the normal mode controller is further configured to operate in the normal mode according to the decoded first main image data and the second additional image data.

11. The display driving circuit of claim 8, further comprising:

an oscillator configured to generate a clock signal; and an internal time information generation circuit configured to generate internal time information based on the clock signal and time information received from outside of the display driving circuit, wherein the AOD mode controller is further configured to operate in the AOD mode based on the internal time information.

12. The display driving circuit of claim 8, further comprising an internal time information generation circuit configured to generate internal time information based on a clock signal received from outside of the display driving circuit and time information received from the outside, wherein the AOD mode controller is further configured to operate in the AOD mode based on the internal time information.

13. A display driving circuit for driving a display panel, the display driving circuit comprising:

a first memory configured to store merged image data received from outside of the display driving circuit;

an image modification circuit configured to extract additional image data from a data area of the merged image data, and to generate main image data by setting a portion of a main image corresponding to the data area to be displayed as a black area;

an internal time information generation circuit configured to generate internal time information based on a clock signal and time information; and an Always On Display (AOD) mode controller configured to operate in an AOD mode having lower power consumption than a normal mode according to the main image data, the additional image data, and the internal time information wherein the image modification circuit is further configured to extract the additional image data from the merged image data based on an address which indicates a position of the additional image data within the main image data.

14. The display driving circuit of claim 13, further comprising a decoder configured to:

receive the merged image data from the first memory;

decode the received merged image data; and transmit the decoded merged image data to the image modification circuit, wherein the image modification circuit is further configured to extract the additional image data from the decoded merged image data.

15. The display driving circuit of claim 13, further comprising a second memory configured to:

receive the additional image data from the image modification circuit;

store the received additional image data; and provide the additional image data to the AOD mode controller.

16. The display driving circuit of claim 13, further comprising a decoder configured to:

receive the main image data from the image modification circuit;

decode the received main image data; and transmit the decoded main image data to the AOD mode controller.

17. The display driving circuit of claim 13, wherein the clock signal is received from the outside.

18. The display driving circuit of claim 13, wherein the address is received from the outside.

19. The display driving circuit of claim 13, wherein the address is pre-stored in the image modification circuit, and wherein the image modification circuit is further configured to extract the additional image data from the merged image data based on the address.

* * * * *